US009631402B2

(12) United States Patent
Bejune et al.

(10) Patent No.: US 9,631,402 B2
(45) Date of Patent: Apr. 25, 2017

(54) DOOR LATCH ASSEMBLY

(71) Applicant: Ford Global Technologies, LLC, Dearborn, MI (US)

(72) Inventors: Daniel Carl Bejune, Southfield, MI (US); Kosta Papanikolaou, Huntington Woods, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 135 days.

(21) Appl. No.: 14/108,935

(22) Filed: Dec. 17, 2013

(65) Prior Publication Data

US 2015/0167358 A1 Jun. 18, 2015

(51) Int. Cl.

| | |
|---|---|
| ***E05C 3/06*** | (2006.01) |
| ***E05B 77/06*** | (2014.01) |
| ***E05B 77/04*** | (2014.01) |
| ***E05B 17/00*** | (2006.01) |
| *E05C 3/16* | (2006.01) |
| *E05B 77/02* | (2014.01) |

(52) U.S. Cl.

CPC ..... *E05B 77/06* (2013.01); *E05B 17/0062* (2013.01); *E05B 77/04* (2013.01); *E05B 77/02* (2013.01); *Y10T 292/1075* (2015.04)

(58) Field of Classification Search

CPC ..... E05B 77/02; E05B 77/04; E05B 77/06
USPC ..... 292/1, 195, DIG. 22, 201, 216
See application file for complete search history.

(56) References Cited

U.S. PATENT DOCUMENTS 3,695,662 A * 10/1972 Ploughman ..... E05B 85/243 292/216
3,709,537 A * 1/1973 Kazaoka ..... E05B 77/02 292/216
3,799,596 A * 3/1974 Nozomu ..... E05B 77/06 180/286
4,382,622 A * 5/1983 Ishikawa ..... E05B 77/12 292/216

(Continued)

FOREIGN PATENT DOCUMENTS

CA 2546400 11/2006
DE WO 2004101924 A1 * 11/2004 ..... E05B 77/02

(Continued)

*Primary Examiner* — Carlos Lugo
(74) *Attorney, Agent, or Firm* — Jason C. Rogers; Bejin Bieneman PLC

(57) ABSTRACT

A vehicle door latch assembly for maintaining the vehicle door in a closed position including during an angled impact to the door latch of the vehicle. The latch assembly includes a catch, a pawl, and an actuator coupled to a door latch base. The catch is movable to and from a closed position wherein the catch is configured to grasp a portion of a striker coupled to the vehicle to maintain the door closed. The catch is also movable to and from an open position wherein the catch is configured to release the striker to allow the door to open. The pawl is configured to maintain the catch in the closed position until the door handle is actuated. The latch assembly includes a blocking plate including an extension member which is deformable during an impact to align with one of or both a pawl lifter and the pawl member to prevent their rotation and thereby maintain the latch assembly and the vehicle door in a latched position during such an impact.

18 Claims, 5 Drawing Sheets

(56) References Cited

U.S. PATENT DOCUMENTS 4,896,907 A * 1/1990 Hayakawa ..... E05B 77/04 292/216
5,813,709 A * 9/1998 Umino ..... E05B 83/36 292/216
5,860,683 A * 1/1999 Sekino ..... E05B 77/06 292/216
5,865,481 A 2/1999 Buschmann
6,010,164 A * 1/2000 Yoda ..... E05B 77/02 292/216
6,601,883 B1 * 8/2003 Kalsi ..... E05B 81/14 292/201
7,048,313 B2 * 5/2006 Fukunaga ..... E05B 77/04 292/216
7,128,349 B2 * 10/2006 Bendel ..... E05B 77/02 292/216
7,481,468 B2 * 1/2009 Merideth ..... E05B 77/06 292/137
7,607,702 B2 * 10/2009 Pereverzev ..... E05B 77/06 292/201
7,648,192 B2 * 1/2010 Herline ..... E05B 77/04 292/92
8,056,944 B2 * 11/2011 Jankowski ..... E05B 77/06 292/201
9,347,246 B2 * 5/2016 Orzech ..... E05B 77/04
2006/0261603 A1 11/2006 Cetnar et al.
2007/0085349 A1 * 4/2007 Merideth ..... E05B 77/06 292/183
2011/0133491 A1 * 6/2011 Perkins ..... E05B 77/10 292/216
2011/0133495 A1 6/2011 Jankowski et al.
2013/0015670 A1 * 1/2013 Perkins ..... E05B 81/28 292/97
2013/0328325 A1 * 12/2013 Uehara ..... E05B 77/06 292/100
2014/0203575 A1 * 7/2014 Brickner ..... E05B 77/12 292/341.17
2014/0291997 A1 * 10/2014 Hunt ..... E05B 77/06 292/92
2016/0017643 A1 * 1/2016 Wahmann ..... E05B 77/54 292/92

FOREIGN PATENT DOCUMENTS

DE WO 2011023182 A2 * 3/2011 ..... E05B 17/0062
DE 102010002736 A1 * 9/2011 ..... E05B 77/02
DE 102012000452 A1 * 9/2012 ..... E05B 77/04
DE 102012025403 A1 * 6/2014 ..... E05B 77/06
DE 102013203808 A1 * 9/2014 ..... E05B 77/06
EP 2295680 3/2011
KR 0145610 5/1998
WO WO 2012107026 8/2012

* cited by examiner

DOOR LATCH ASSEMBLY

BACKGROUND

The present disclosure generally relates to vehicles and, more particularly, relates to a door latch assembly having particular utility in a door of a vehicle.

It is generally known to provide a door latch assembly for use in a vehicle. Door latch assemblies design may vary based on a variety of factors including, but not limited to, the type of vehicle (e.g., car, minivan, sport utility, crossover, pickup truck, etc.) as well as the location of the latch assembly in the vehicle. It is also generally known to provide a latch assembly in a door of a vehicle that may be operated by a single or double pull mode using door handles located on the outside and inside of the door of the vehicle. The door latch assembly must be capable of performing in a variety of modes and in numerous adverse circumstances including during an impact to the vehicle. There long remains a continuing and significant need to provide improved impact performance of a door latch assembly for use in a vehicle.

DRAWINGS

DETAILED DESCRIPTION

Figure 1:
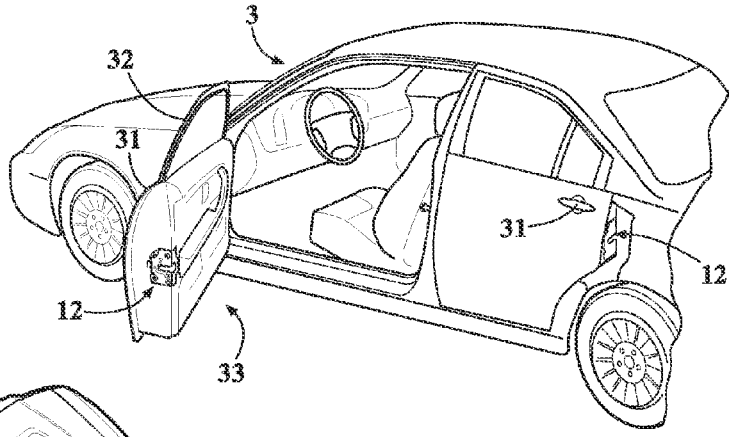
FIG. 1 is a partial, perspective graphic view of a vehicle including a door and a door latch assembly according to an exemplary embodiment of the present disclosure.

Referring in general to all of the Figures there is disclosed an exemplary embodiment of a vehicle door latch mechanism or assembly 12 for use in a vehicle 3. The door latch assembly 12 may be coupled or assembled in a door 32 of the vehicle 3 as best shown in FIG. 1. The door 32 of the vehicle 3 may further include a handle 31 for operating the latch assembly 12 coupled in the door 32 of the vehicle 3 for unlatching the latch assembly 12 so the door 32 may be opened such as during entering and exiting the vehicle 3

Figure 2:
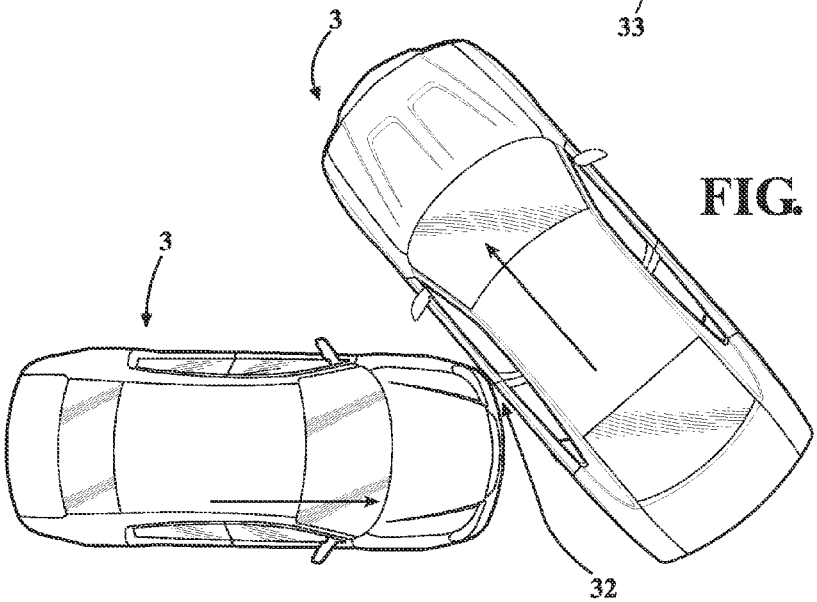
FIG. 2 is top graphic view of a second vehicle angularly impacting the door of a first vehicle including a door latch assembly according to the present disclosure.
Figure 2A:
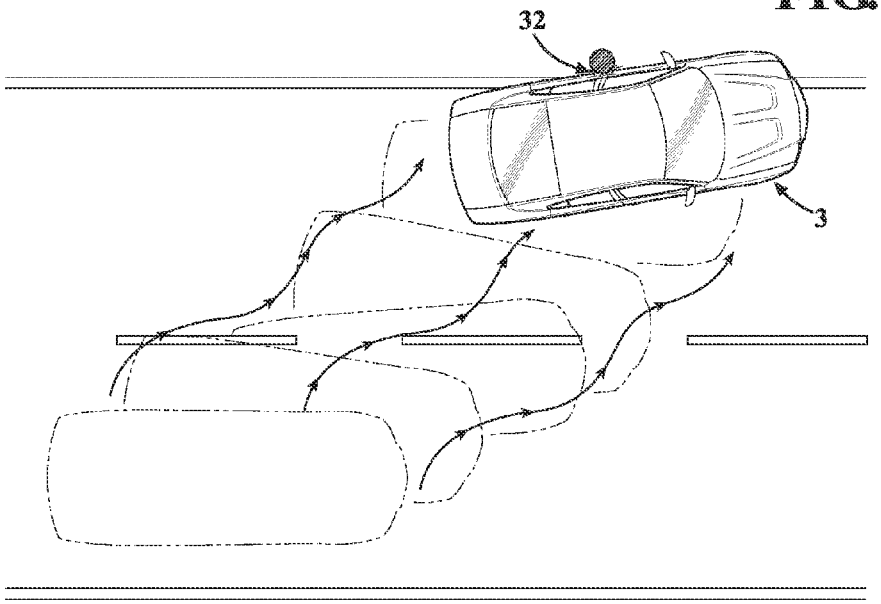
FIG. 2A is top graphic view of a skidding vehicle angularly impacting a pole or other similar round object near a door latch assembly according to the present disclosure.

The latch assembly 12 has particular utility in maintaining the integrity of the latch assembly 12 during an impact to a door 32 of the vehicle 3 as best shown in FIGS. 2 and 2A to improve the overall integrity of the vehicle 3 and to better protect the occupants during an impact to the door of the vehicle 3. As graphically shown in FIG. 2, a first vehicle 3 is driving in a first direction and a second vehicle 3 is driving in a substantially opposite direction. Regardless of the reason, the second vehicle 3 angularly impacts the first vehicle 3 approximately at the location of the door 32 and near a latch assembly 12 therein. In the type of impact shown in FIG. 2, a second vehicle 3 causes an inward and/or rearward intrusion of the outer panel of the door 32 which material is moved toward the latch assembly 12. Similar types of impacts to the vehicle may occur when a vehicle 3 impacts a pole, tree or other similar stationary object as best shown in FIG. 2A. The latch assembly 12 according to the present disclosure is designed to better prevent the latch assembly 12 from being released during such an impact to the internal structures of the door 32 with the assembly.

Figure 4:
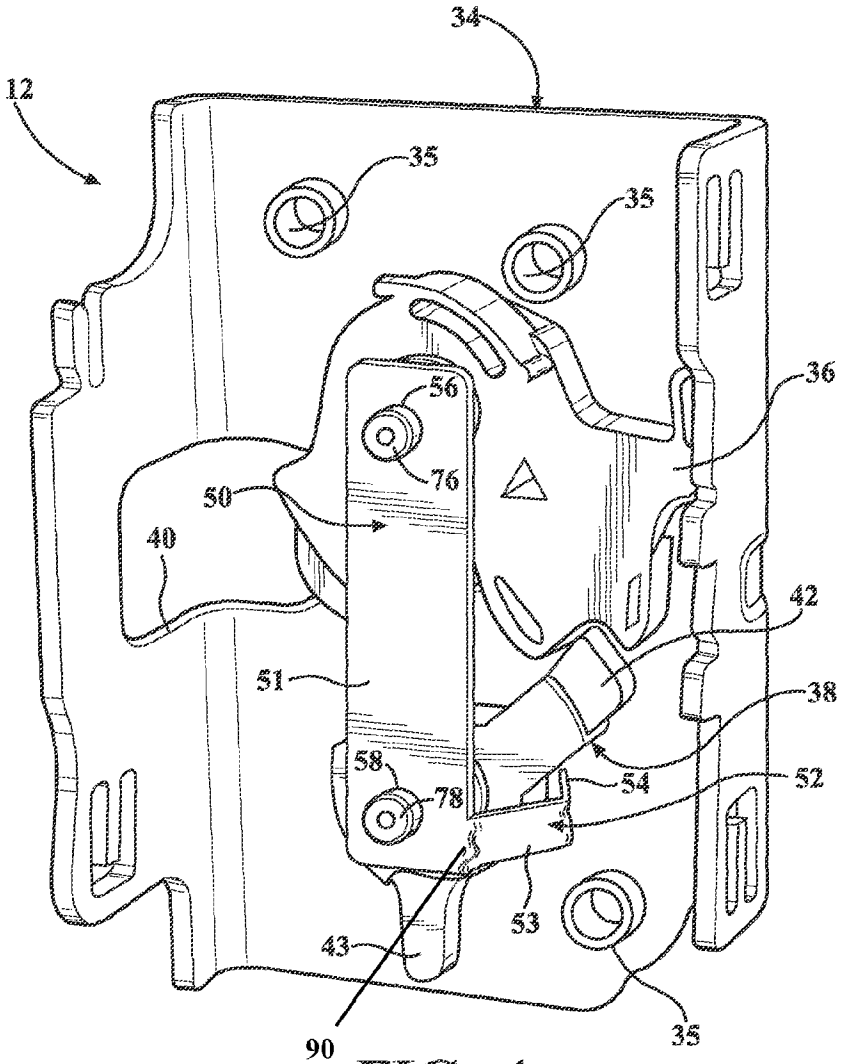
FIG. 4 is a partial, side, perspective graphic view of the door latch assembly of FIG. 3 an impact such as those shown in of FIGS. 2 and 2A.
Figure 3:
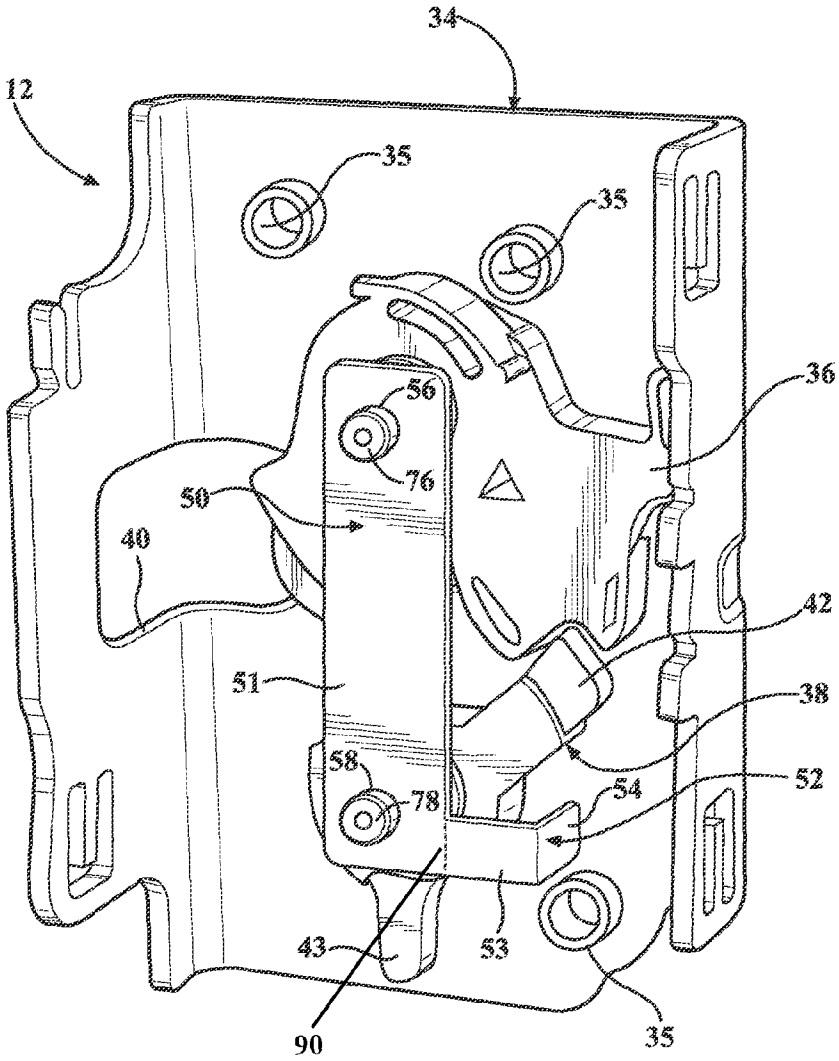
FIG. 3 is a partial, side, perspective graphic view of the door latch assembly of an exemplary embodiment of the present disclosure.

In one exemplary embodiment of the present disclosure, as shown in FIGS. 3 and 4, the latch assembly 12 may include a latch frame housing or frame plate 34 having a generally planar long side and a pair of depending side legs as is generally known and used in vehicle door latches. The housing plate 34 may include a plurality of bosses or passages 35 used in coupling the door latch assembly to the door 32 of the vehicle 3. The door latch assembly 12 may further include a claw or catch 36 that may be rotatably connected or coupled with the housing plate 34. The housing plate 34 may further include a post or extension 76 upon which the claw 36 rotates. The housing plate 34 of the latch assembly 12 may further include a striker slot 40 for providing access to a striker retaining slot in the claw 36 for receiving a rod or bar of a door latch striker member (not shown) coupled to the pillar or post of the vehicle 3. A pawl 38 may be operably connected or coupled proximal the claw 36 on the latch assembly housing frame plate 34 as is generally known and understood. The housing plate 34 of the latch assembly 12 may further include a post or extension 78 upon which the pawl 38 is rotatably supported. The pawl 38 may further include a claw block extension member 42 for selectively blocking rotation of the claw 36. The pawl 38 may further include a lower extension 43 for actuating the pawl 38.

In the illustrated example shown in FIG. 3, the latch assembly 12 may be configured to maintain the door 32 closed and selectively actuated to allow the door 32 to open. As is generally known, FIG. 3 illustrates the claw or catch 36 in a closed or latched position wherein the striker coupled to the pillar (not shown) of the vehicle 3 would be trapped within the slot of the claw 36 such that the door 32 is latched closed. The pawl 38 may be configured to maintain the catch 36 in the closed position by having the extension 42 of the pawl 38 abut against a surface or portion of the catch 36 to prevent rotation of the catch 36 when a force attempts to open the door without the pawl 38 being actuated. The pawl 38 may be configured to rotate clockwise, as shown in FIG. 3, in response to the motion of an inner or outer door handle, such that the extension 42 of the pawl 38 no longer abuts the surface of the claw 36 to allow the claw or catch 36 to rotate to a released or open position. Once the extension 42 of the pawl 38 moves out of engagement with the catch 36, the catch 36 may be configured to rotate clockwise to the open or unlatched position to release the door striker coupled to the pillar of the vehicle (not shown) thereby allowing the door 32 to be opened. The structure and function of the catch 36 and the pawl 38 as discussed directly above are generally known to those skilled in the art.

In one exemplary embodiment of the present disclosure, the latch assembly 12 may further include a generally planar blocking or plate member 50. The blocking plate 50 is a generally planar member including a first hole or passage 56 located on the post 76 and a second hole or passage 58 located on the post 78. Accordingly, the plate member 50 sandwiches the claw or catch 36 and the pawl 38 as shown in the configuration in FIGS. 3 and 4. The blocking member 50 may preferably have a generally, overall L shape and may preferably be made from a relatively ductile metal material. The blocking member 50 may preferably include a main body portion 51 having a substantially generally rectangular configuration and including a unitary or integral extension member 52 that provides the mentioned L-shape configuration. The main body portion 51 and the extension member 52 meet at a boundary 90. The boundary 90 defines a line where the body portion 51 of the blocking member 50 ends and the extension member 52 of the blocking member 50 begins. The extension member 52 includes a first laterally extending portion 53 that is generally in the same or similar plane as the main body portion 51. In one alternate exemplary embodiment of the present disclosure, the extension member 52 may be offset from the plane of the main body portion 51. The first leg or portion 53 extends laterally predetermined distance. The extension member 52 of the blocking member 50 may further include a second leg or extension portion 54 that extends from a distal end of the first leg or portion 53. The second extension portion 54 may preferably extend in a direction substantially perpendicular to the first leg or portion 53 of the extension member 52 of the blocking member 50. In particular, the second extension portion 54 may preferably extend in a direction toward the latch housing plate 34. In an alternate exemplary embodiment, the extension member 52 may be separately produced and integrated with the body portion 51 at the boundary 90 to form the generally planar blocking member 50. It should be noted that while the blocking member 50 may be of the exemplary embodiment shown, a generally planar member, it is contemplated that it may also take any other appropriate form or shape provided the extension member 52 may function to allow the pawl 38 to work freely during normal operation and, during and after an impact as noted herein, the extension member 52 may function to block the pawl 38 and/or the pawl lifter, as better explained below.

It should be noted that the extension member 52 of the blocking member 50 is originally aligned offset from the extension member 42 of the pawl member 38 in a direction opposite the latch plate 34. During an impact event like the events shown in FIGS. 2 and 2A, the extension member 52 is deformed and/or displaced in a direction generally toward the latch plate 34 and into a blocking position of the pawl 38 as best shown in FIG. 4. The extension member 52 is deformed and/or displace by the inner portions of the door 3 to block the pawl 38 and prevent it from rotation and thereby preventing the claw or catch 36 from rotation and/or release of the door striker which provides a confirmed latching of the door 3 during the impact and helps to prevent unintended unlatching of the latch assembly 12 during such an impact.

Figure 6:
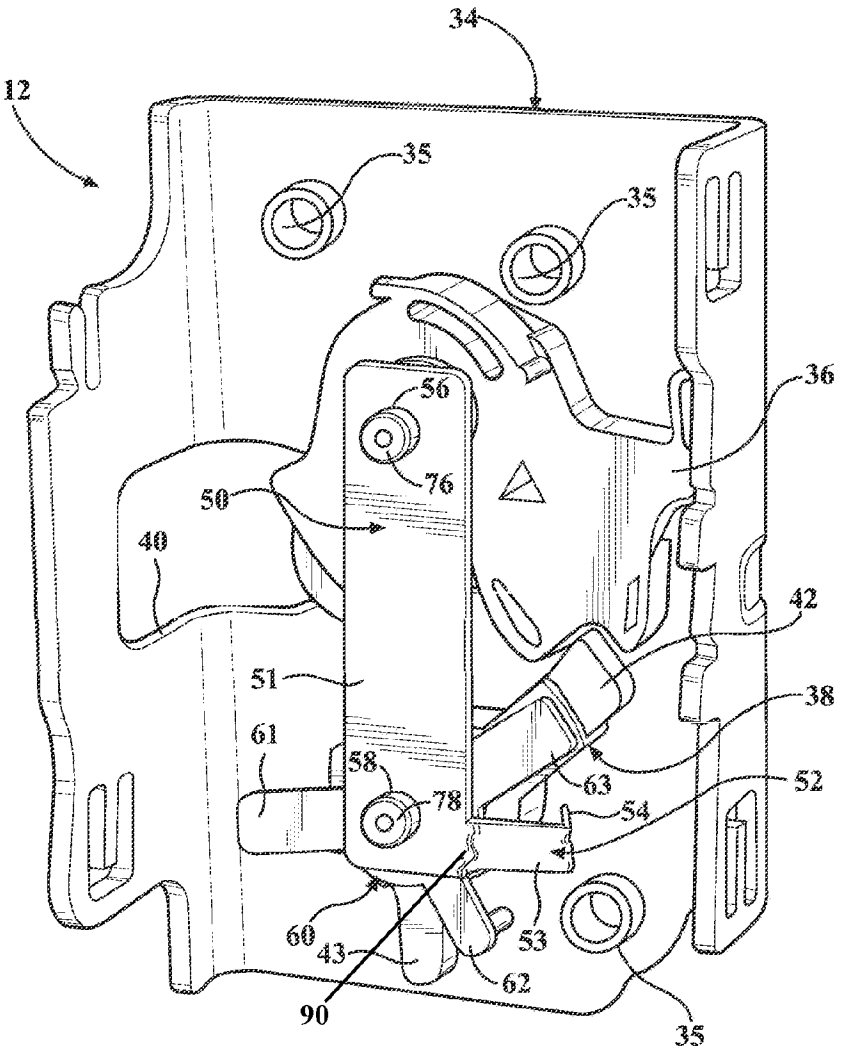
FIG. 6 is a partial, side, perspective graphic view of the door latch assembly of FIG. 5 after an impact such as those shown in of FIGS. 2 and 2A.
Figure 5:
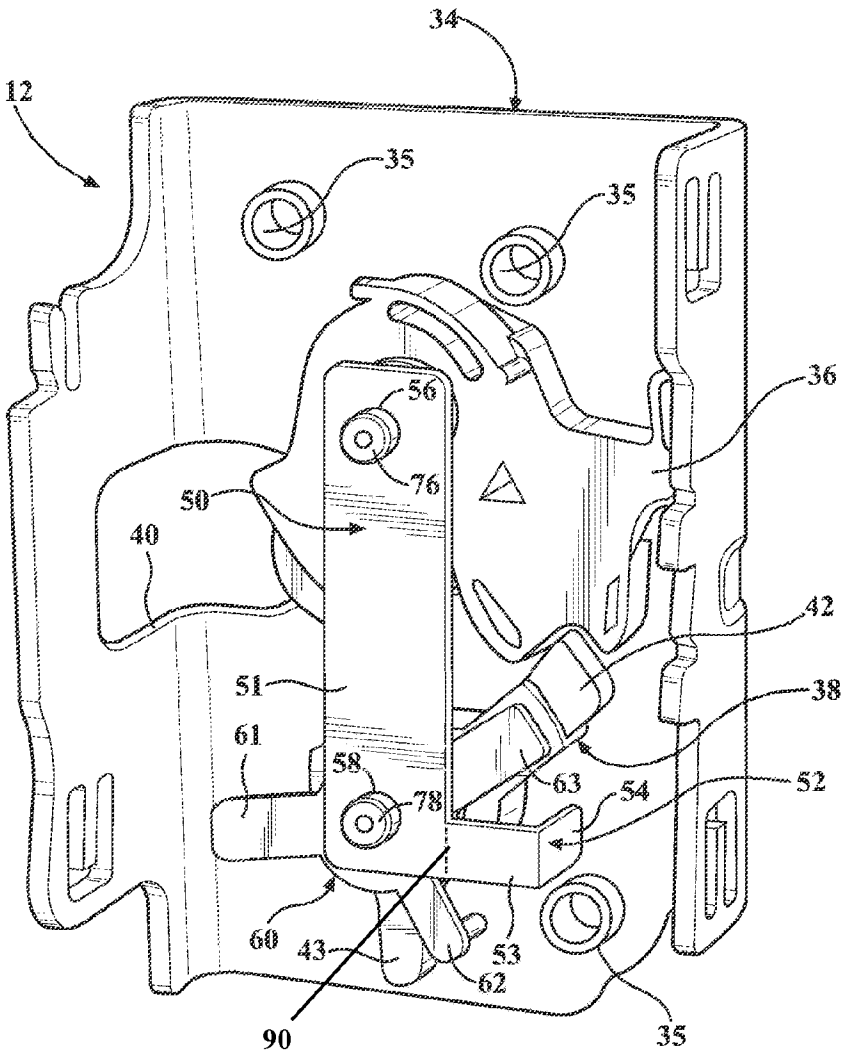
FIG. 5 is a partial, side, perspective graphic view of a door latch assembly of an alternate exemplary embodiment of the present disclosure.

Referring now in particular to FIGS. 5 and 6, there is disclosed an alternate exemplary embodiment of a latch assembly 12 according to the present disclosure. The latch assembly 12 of FIGS. 5 and 6 includes a pawl lifter or operating member 60 rotatably supported on the post 78 and located between the blocking member 50 and the pawl 38. The pawl lifter 60 includes a first extension member 61 and a second extension member 62. The first extension member 61 of the pawl lifter 60 is for coupling to the linkage of the door handle for operating the latch assembly 12. Upon actuation of the extension member 61 to rotate the pawl lifter 60 and a clockwise direction as shown in FIGS. 5 and 6, the second extension member 62 of the pawl lifter 60 engages the lower extension 43 of the pawl 38 causing the pawl 38 to rotate clockwise to move the extension member 42 from the recess in the claw or catch 36 to release the latch assembly 12. In the latch assembly 12 of FIGS. 5 and 6, during an impact as shown in FIGS. 2 and 2A, again the extension member 52 of the blocking member 50 is moved in a direction toward the latch plate 34 to block the pawl lifter 60 and/or the pawl 38 by blocking a third extension member 63 of the pawl lifter 60 and or the extension member 42 of the pawl 38 as best shown in FIG. 6.

Figure 8:
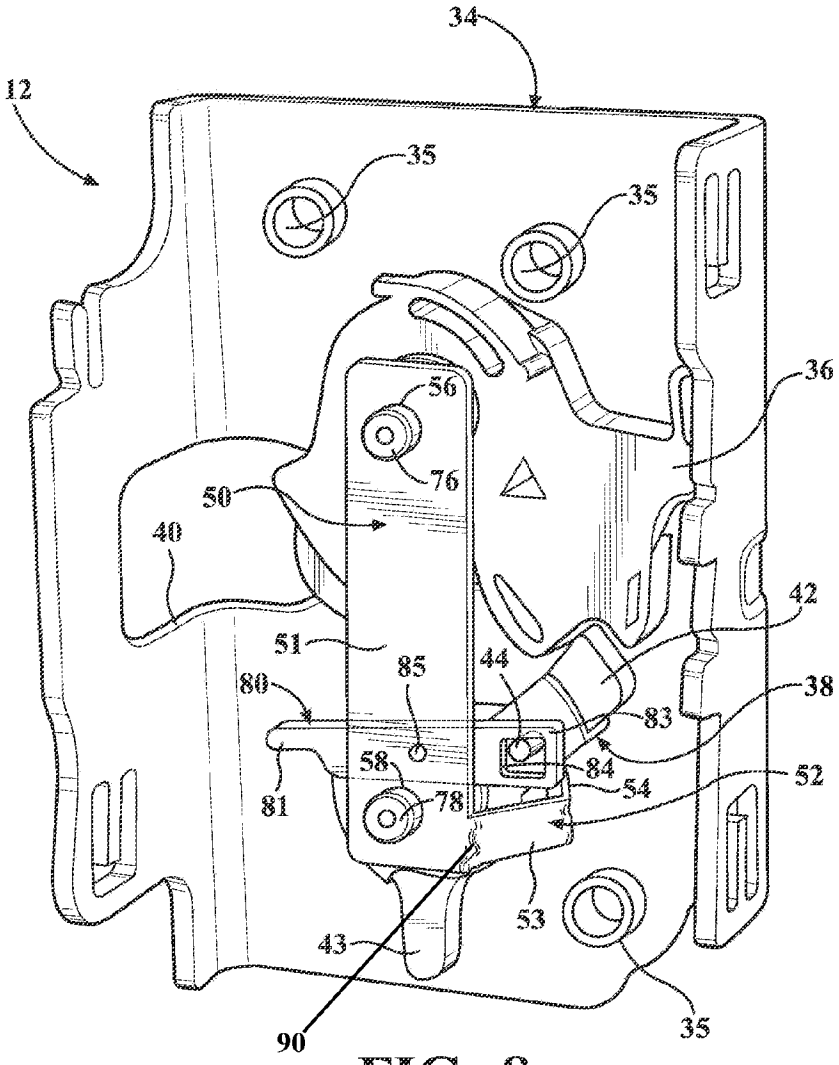
FIG. 8 is an alternate partial, side, perspective graphic view of the door latch assembly of FIG. 7 after an impact such as those shown in of FIGS. 2 and 2A.
Figure 7:
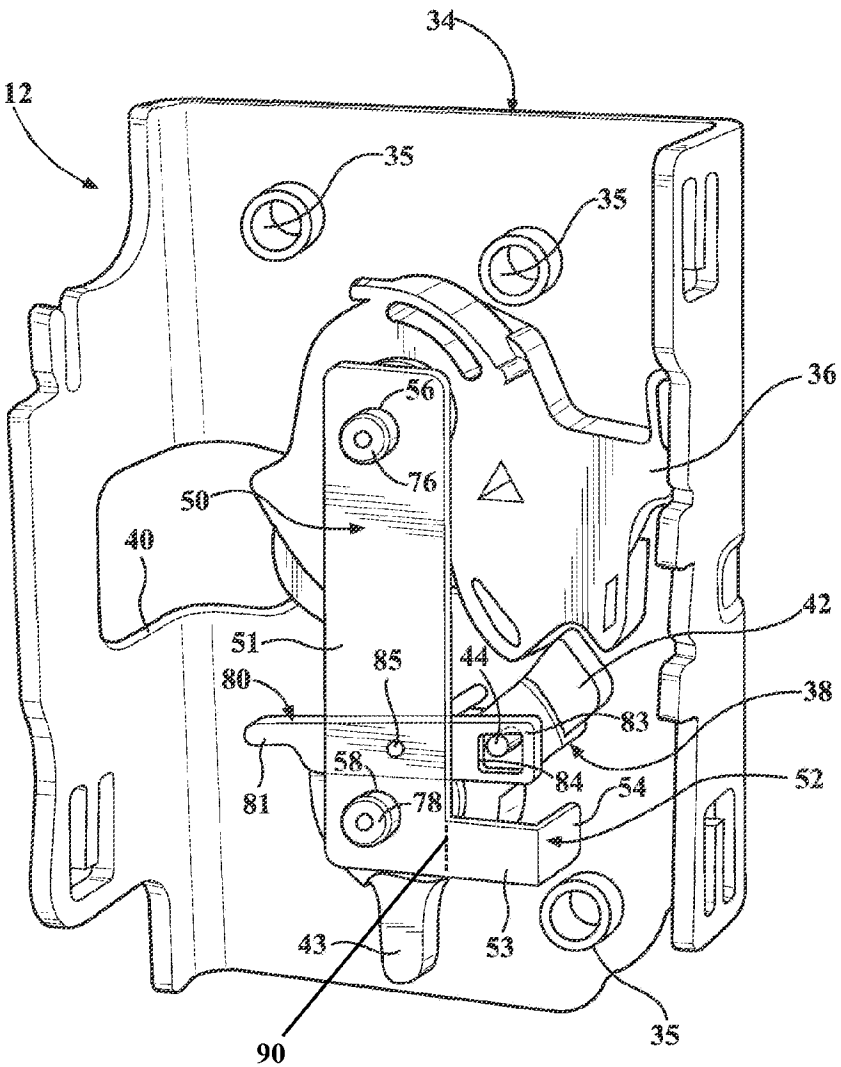
FIG. 7 is a partial, side, perspective graphic view of a door latch assembly of a further alternate exemplary embodiment of the present disclosure.
Figure 9:
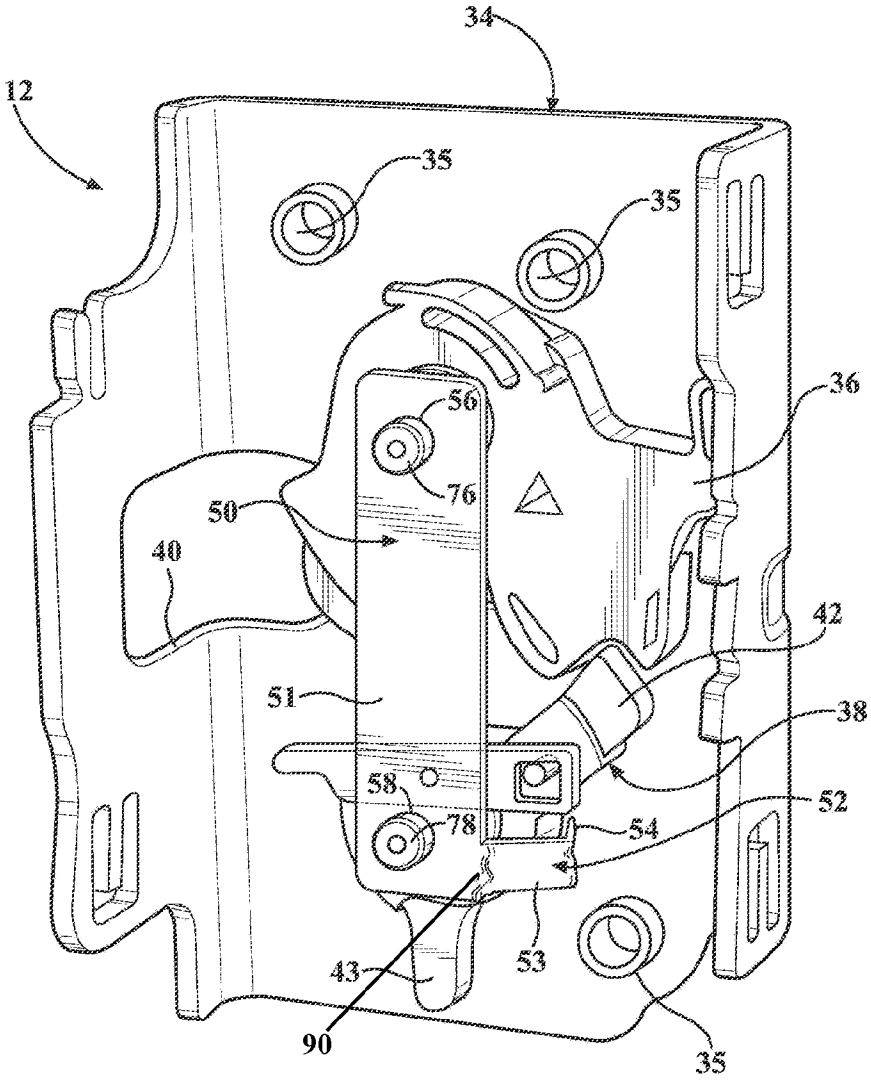
FIG. 9 is a further alternate partial, side, perspective graphic view of the door latch assembly of FIG. 7 after an impact such as those shown in of FIGS. 2 and 2A.

Referring now in particular to FIGS. 7 through 9, there is disclosed a further alternate exemplary embodiment of a latch assembly 12 according to the present disclosure. In the current exemplary embodiment, the latch assembly 12 may further include a pawl lifter 80 rotatably supported on a post 85 extending between a hole in the blocking plate member 50 and the latch housing plate 34. The pawl lifter 80 may further include a first end 81 for coupling to the linkage of the door handles for operating the latch assembly 12. Upon actuation of one of the door handles of the vehicle door, the linkages coupled thereto may cause the extension member 81 of the pawl lifter 82 rotate on the post 85 in a counter-clockwise direction.

In the embodiment of the latch assembly 12 of FIGS. 7 through 9, the pawl lifter 80 may further include a second end or extension 83 including a window or passage 84 therein for receiving a post 44 coupled to the extension 42 of the pawl 38. The window 84 in the end 83 of the pawl lifter 80 may be sized to provide some free play in the latch assembly 12 while also providing actuation of the pawl 38 in response to the actuation of the door handles of the vehicle 3. The pawl lifter 80 rotates about the post 85 a sufficient amount so that rotation of the pawl lifter 80 in the clockwise direction may cause the window 84 to engage the post 44 of the extension member 42 to rotate the pawl member 38 clockwise out of engagement with the recess or abutment of the claw or catch 36 to thereby allow rotation of the claw 36 to release the door striker from the latch assembly 12. In the latch assembly 12 of FIGS. 7 through 9 during an impact as shown in FIGS. 2 and 2A, the extension member 52 of the blocking member is moved in a direction toward the latch plate or housing 34 to block the pawl lifter 80 and/or the pawl 38 to prevent unlatching of the door latch assembly 12. As best shown in FIG. 8, during such an impact, the extension member 52 may be sufficiently impacted such that the first portion 53 and the second portion 54 of the extension member 52 are moved or bent from the main body portion 51 and toward the latch plate housing 34 to prevent rotation of both the pawl lifter 80 and the pawl 38. In the further alternate embodiment as shown in FIG. 9, during such an impact, the extension member 52 may be moved sufficiently toward the latch plate housing 34 to prevent rotation of the pawl lifter 80 which is sufficient to prevent the pawl 38 from being rotated due to the engagement of the pin 44 coupled to the extension member 42 of the pawl 38 in the window 84 of the end 83 of the pawl lifter 80. The latch assemblies 12 of the exemplary embodiments of the present disclosure provide more effective solutions to the long remaining and continuing significant need for an improved impact performance door latch assembly for use in a door 32 of a vehicle 3.

The present description is intended to be illustrative and not restrictive. Many embodiments as well as many applications besides the examples provided will be apparent to those of skill in the art upon understanding the present disclosure. The scope of the claimed invention should, therefore, not be determined with limiting reference to the description, but should instead be determined with reference to the appended claims, along with the full scope of equivalents to which such claims are entitled. Any disclosure of an article or reference, including patent applications and publications, is incorporated by reference herein for all purposes. Any omission in the following claims of any aspect of subject matter disclosed herein is not a disclaimer of such subject matter.

Any numerical values recited herein or in the figures are intended to include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition.

Unless expressly stated, all ranges are intended to include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The use of the term "consisting essentially of" to describe a combination shall include the elements, ingredients, components or steps identified, and such other elements ingredients, components or steps that do not materially affect the basic and novel characteristics of the combination. The disclosure of "a" or "one" to describe an element, ingredient, component or step is not intended to foreclose additional elements, ingredients, components or steps. Plural elements, ingredients, components or steps can be provided by a single integrated element, ingredient, component or step. Alternatively, a single integrated element, ingredient, component or step might be divided into separate plural elements, ingredients, components or steps.

We claim:

1. A door latch assembly comprising:

a housing including a first post defining a first axis and a second post defining a second axis;

a pawl including a pawl extension member configured to engage a first abutment surface of a claw, the pawl rotatably mounted on the second post;

a pawl lifter rotatably mounted on the second post; and a blocking member including a body portion connected to at least one of the first post and the second post and a blocking extension member extending from an outer edge of the body portion, wherein the blocking extension member is arranged to deform toward a rotational path of the pawl lifter to block rotation of the pawl lifter upon application of a force received by the blocking extension member.

2. The door latch assembly of claim 1, wherein the blocking member is coupled to the first and second posts.

3. The door latch assembly of claim 1, wherein the blocking extension member is arranged to also block the pawl from rotating.

4. The door latch assembly of claim 1, wherein the housing is a frame plate for a vehicle door latch.

5. A latch assembly, comprising:

a housing including a first post and a second post;

a claw rotatably connected to the first post;

a pawl rotatably connected to the second post and arranged to hold the claw in a locked position;

a pawl lifter rotatably connected to the second post;

a blocking member including a body portion connected to the second post; and an extension member extending from an outer edge of the body portion and arranged to deform toward a rotational path of the pawl lifter to block rotation of the pawl lifter upon application of a force received by the extension member.

6. The latch assembly of claim 5, wherein the body portion and the extension member are formed in a unitary construction.

7. The latch assembly of claim 5, wherein the body portion and the extension member are formed separately.

8. A latch assembly, comprising:

a housing plate;

a claw rotatably supported on the housing plate;

a pawl rotatably supported on the housing plate and arranged to hold the claw in a locked position;

a pawl lifter rotatably supported on the mounting plate; and a blocking member including blocking means for allowing rotation of the pawl lifter during operation of a vehicle and deforming toward a rotational path of the pawl lifter and blocking rotation of the pawl lifter upon application of a force received by the blocking means.

9. The latch assembly of claim 8, wherein the blocking member and the blocking means are formed in a unitary construction.

10. The latch assembly of claim 8, wherein the blocking member and the blocking means are formed separately.

11. The latch assembly of claim 8, wherein the blocking means blocks both the pawl lifter and the pawl during the impact.

12. The latch assembly of claim 11, wherein the pawl lifter and the pawl are rotatable about a same axis.

13. The latch assembly of claim 8, wherein the housing plate includes a first post defining a first axis and a second post defining a second axis.

14. The latch assembly of claim 13, wherein the claw is rotatably connected to the first post and the pawl is rotatably connected to the second post.

15. The latch assembly of claim 13, wherein the pawl lifter is rotatably connected to the second post.

16. The latch assembly of claim 13, further comprising a pawl lifter rotatably connected to the blocking member along a third axis offset from the first and second axes.

17. The latch assembly of claim 8, wherein the blocking means retains the claw in the locked position when the blocking means blocks rotation of the pawl lifter.

18. A door latch assembly comprising:

a housing including a first post defining a first axis and a second post defining a second axis;

a pawl including a pawl extension member configured to engage a first abutment surface of a claw, the pawl rotatably mounted on the second post;

a blocking member including a body portion and a blocking extension member extending from an outer edge of the body portion, wherein the blocking extension member is arranged to deform toward a rotational path of the pawl to block rotation of the pawl upon application of a force; and a pawl lifter rotatably mounted on the second post;

wherein the blocking extension member is arranged to block the pawl lifter from rotating.

* * * * *